US010450104B2

(12) United States Patent
Han

(10) Patent No.: US 10,450,104 B2
(45) Date of Patent: Oct. 22, 2019

(54) STORAGE TOTE WITH LATCHING HANDLE

(71) Applicant: BARENTHAL NORTH AMERICA, INC., Whippany, NJ (US)

(72) Inventor: Hongyuan Han, New Vernon, NJ (US)

(73) Assignee: BARENTHAL NORTH AMERICA, INC., Whippany, NJ (US)

( * ) Notice: Subject to any disclaimer, the term of this patent is extended or adjusted under 35 U.S.C. 154(b) by 74 days.

(21) Appl. No.: 15/896,837

(22) Filed: Feb. 14, 2018

(65) Prior Publication Data

US 2018/0237185 A1 Aug. 23, 2018

Related U.S. Application Data

(60) Provisional application No. 62/460,320, filed on Feb. 17, 2017.

(51) Int. Cl.

| | |
|---|---|
| ***B65D 21/02*** | (2006.01) |
| ***B65D 1/22*** | (2006.01) |
| ***B65D 21/06*** | (2006.01) |
| ***B65D 43/16*** | (2006.01) |
| ***B65D 45/20*** | (2006.01) |

(52) U.S. Cl.

CPC ..... *B65D 21/0223* (2013.01); *B65D 1/22* (2013.01); *B65D 21/0216* (2013.01); *B65D 21/0222* (2013.01); *B65D 21/06* (2013.01); *B65D 43/167* (2013.01); *B65D 45/20* (2013.01); *B65D 2251/1083* (2013.01)

(58) Field of Classification Search

CPC .... B65D 21/00–0223; B65D 45/00–20; B65D 1/00–22; B65D 43/00–167; B65D 2251/00–1083

See application file for complete search history.

(56) References Cited

U.S. PATENT DOCUMENTS 5,564,805 A * 10/1996 Dickinson ..... B25H 3/02 206/505
5,641,065 A * 6/1997 Owens ..... B65D 45/20 206/363
6,793,096 B1 * 9/2004 Seok ..... B65D 43/0218 220/326
7,090,089 B2 * 8/2006 Lown ..... B65D 43/0218 220/324

(Continued)

*Primary Examiner* — Kareen K Thomas

(74) *Attorney, Agent, or Firm* — Preti Flaherty Beliveau & Pachios LLP

(57) ABSTRACT

A storage tote system includes a body having a peripheral upper edge and hinged latches located at either end the peripheral upper edge. Each hinged latch includes lateral arms having pivot pins. The lateral arms are connected to an upper flange. The upper flange has an engagement tab extending from its lower surface. The storage tote system also includes a lid with an upper surface having complimentary recessed features on opposite ends, and a peripheral, downwardly facing groove.

Each hinged latch is configured to be rotated about their pivot pins so that the upper flange is rotated onto the complimentary recessed feature. An aperture formed within the recessed feature of the lid's upper surface receives the engagement tab to securing the lid onto the body. Each hinged latch can also be rotated outwardly, away from the lid in order to disengage the engagement tab without deforming the lid.

11 Claims, 20 Drawing Sheets

(56) References Cited

U.S. PATENT DOCUMENTS

| | | | | |
|---|---|---|---|---|
| 7,854,370 | B2 * | 12/2010 | Turvey | B65D 5/3607 220/4.28 |
| 8,146,773 | B2 * | 4/2012 | Turvey | B65D 11/186 220/6 |
| 8,534,492 | B2 * | 9/2013 | Smyers | B65D 53/02 206/511 |
| 10,173,826 | B2 * | 1/2019 | Sexton | B65D 45/20 |
| 2003/0010783 | A1 * | 1/2003 | Prezelin | B65D 45/20 220/324 |
| 2012/0267369 | A1 * | 10/2012 | Duvigneau | B29C 45/0081 220/203.01 |

* cited by examiner

STORAGE TOTE WITH LATCHING HANDLE

STATEMENT REGARDING FEDERALLY SPONSORED RESEARCH OR DEVELOPMENT

N/A

BACKGROUND OF THE INVENTION

Various embodiments relate generally to storage systems and devices and, more specifically, relate to storage totes with latching handles.

This section is intended to provide a background or context. The description may include concepts that may be pursued, but have not necessarily been previously conceived or pursued. Unless indicated otherwise, what is described in this section is not deemed prior art to the description and claims and is not admitted to be prior art by inclusion in this section.

Plastic storage containers, commonly referred to as storage totes, are well-known for their usefulness in organizing, storing, and protecting a variety of goods. Such totes typically comprise a body portion and a lid portion. In some instances, the lid is integral with the body, such as through a hinge, and may in fact comprise two or more hinged lid sections. However, such hinged lid totes are more complex to manufacture, may have increased weight due to the extra material required in the hinge(s), and thus may be more expensive for a consumer.

In other, more basic, instances, the lid is discrete from the body and comprises plural physical features about a peripheral edge adapted to be mechanically, releasably engaged with complimentary physical features disposed about an upper edge of the body. Specifically, the lid may comprise a downwardly facing peripheral groove having a plurality of tabs or barbs therein. The body may comprise an upper edge formed by an upwardly extending body wall that runs outward then downward over a limited distance. When the lid is pushed down onto the upper edge of the body, the upper edge extends into the channel and the tabs or barbs engage with a downwardly facing edge of the body wall adjacent the upper edge. Typically, the tabs or barbs are provided proximate handles formed into the body and opposite ends of the body, proximate the upper edge. Thus, when a user wishes to release the lid from the body, the user pulls one or both ends of the lid outwardly in an effort to disengage the tabs or barbs from the body wall. However, depending upon the rigidity of the plastic from which the lid is formed, this may take a significant amount of force. Over time, plastic may become brittle, particularly when exposed to temperature extremes sometimes found in locations where totes are located for long-term storage. Deformation for the purpose of disengaging tabs or barbs on the lid from the body wall sometimes results in cracking or breaking the plastic forming the lid.

In addition, prior art totes are typically configured to be vertically nested for shipping and for storage prior to sale and prior to use at a user's location. However, the body configurations have not been fully optimized for maximum vertical density.

What is needed is a tote system comprising a body and a lid that enables secure engagement of a lid onto a body, that enables simple disengagement of the lid from the body, and that is configured to maximize the number of vertically nested totes within a given vertical distance for more efficient shipping and storage capabilities.

BRIEF SUMMARY OF THE INVENTION

The below summary is merely representative and non-limiting.

The above problems are overcome, and other advantages may be realized, by the use of the embodiments.

In a first aspect, an embodiment provides a storage tote system with latching handle, the system comprising a body and lid. The body is provided with a peripheral upper edge. Oppositely disposed hinged latches are disposed proximate the upper edge of the body at either end thereof Each latch is provided with lateral arms having pivot pins extending in a horizontal plane, orthogonal to the arms. The arms are connected to an upper flange having at least one engagement tab extending from a lower surface thereof. The lid is provided with complimentary recessed features on an upper surface at opposite ends and with a peripheral, downwardly facing groove. When the groove of the lid is disposed on the upper edge of the body, each latch may be rotated about the respective pivot pins, whereby the flange is rotated over and onto the respective complimentary recessed feature. At least one aperture formed within the recessed feature receives the at least one engagement tab extending from the latch, thus locking the lid onto the body. Rotating the latch outwardly, away from the lid, disengages the tab from the aperture without the need for deforming the lid.

Disposed on opposite side walls or ends of the body are recessed panels that extend into an interior of the body. At an upper end of each panel, the body upper edge forms a handle suitable for engagement by a user for lifting and carrying the tote, with or without a lid mounted thereon. Beneficially, the interior profile of the recessed panel of a first tote body is dimensioned to be received within the exterior profile of the recessed panel of a second tote body that is disposed within the first. The vertical height of the body upper edge is minimized. Combined, these features optimize the vertical density of stacked tote bodies within a given vertical height.

Further, the lid groove has a minimized vertical height and the lid has a recessed central portion. The downwardly facing groove of a first lid is dimensioned to fit over an upper surface of a groove of a second lid, the recessed central portion of the first lid extending downwardly into the recessed central portion of the second lid. These features also optimize the vertical density of stacked lids within a given vertical height.

The shape of the handle operates in conjunction with the tote design to enable the overall improved nesting capability. The handle and tote design can be applied to any sized tote. Thus, within a prescribed vertical height, an increased number of tote bodies and complimentary lids may be shipped or stored.

BRIEF DESCRIPTION OF THE SEVERAL VIEWS OF THE DRAWINGS

Various features and advantages will be apparent from the following description of the embodiments thereof and from the claims, taken in conjunction with the accompanying drawings, in which:

DETAILED DESCRIPTION OF THE INVENTION

This patent application claims priority from U.S. Provisional Patent Application No. 62/460,320, filed Feb. 17, 2017, the disclosure of which is incorporated by reference herein in its entirety.

Figure 1:
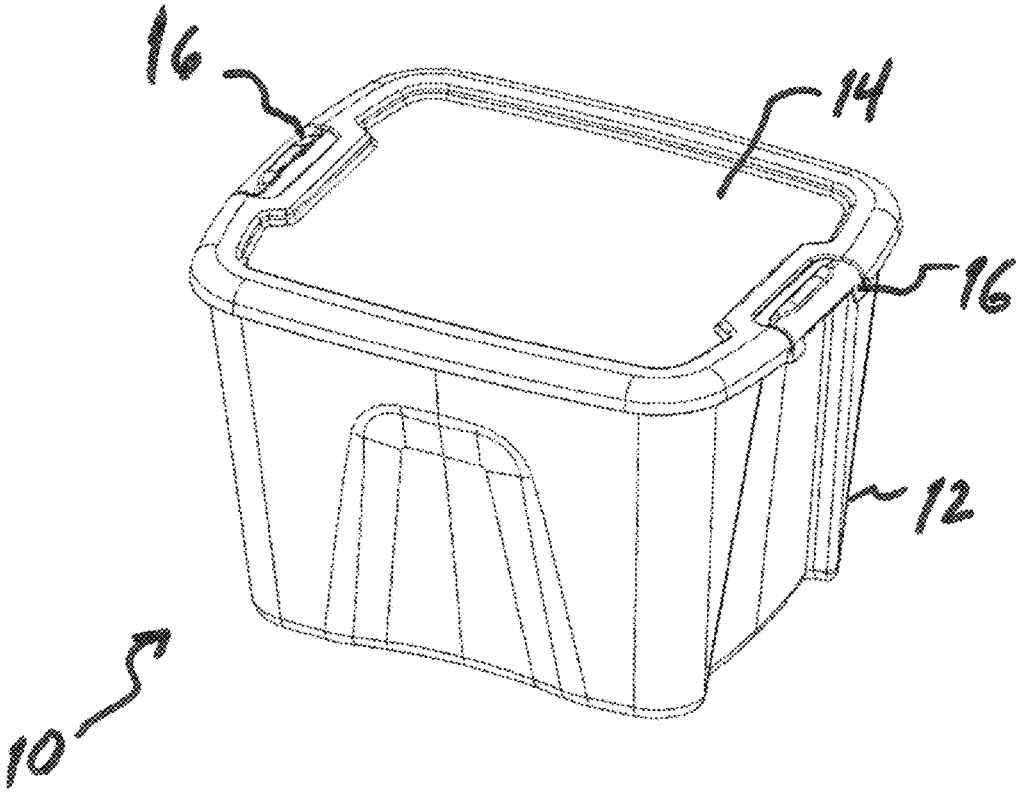
FIG. 1 is a front, right, top perspective view of a storage tote according to an embodiment.
Figure 2:
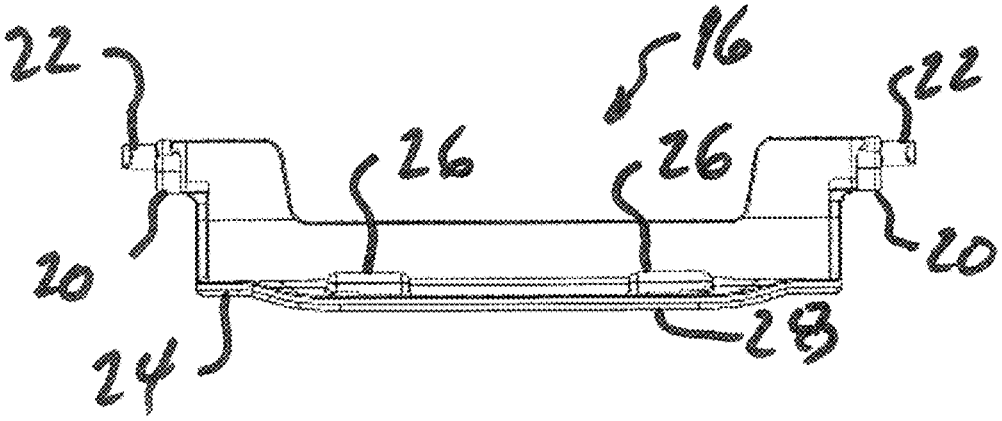
FIG. 2 is a view of a hinge of the tote of FIG. 1.
Figure 3:
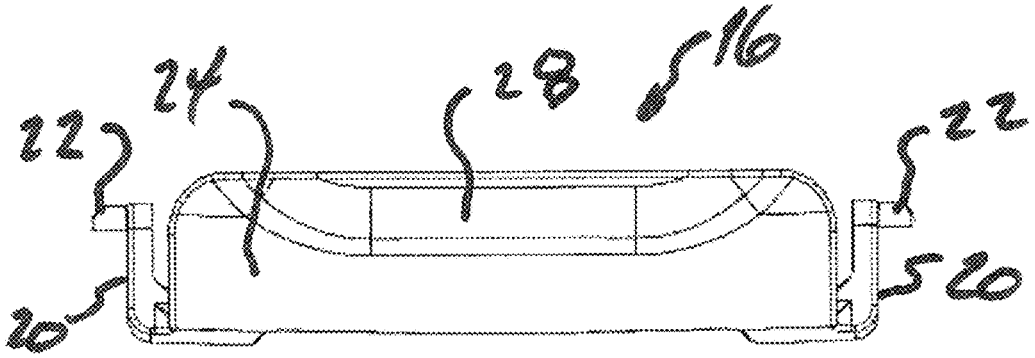
FIG. 3 is a front elevation view of the hinge of FIG. 2.
Figure 4:
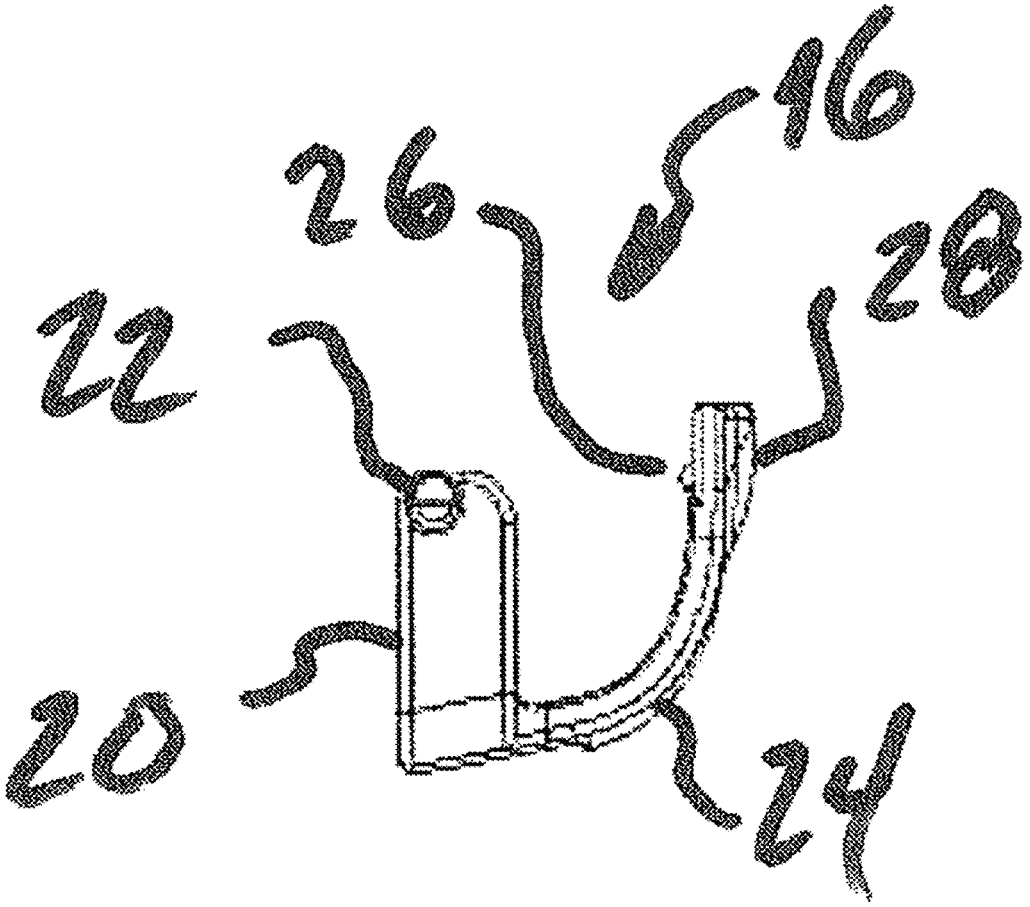
FIG. 4 is a side elevation view of the hinge of FIG. 2.
Figure 5:
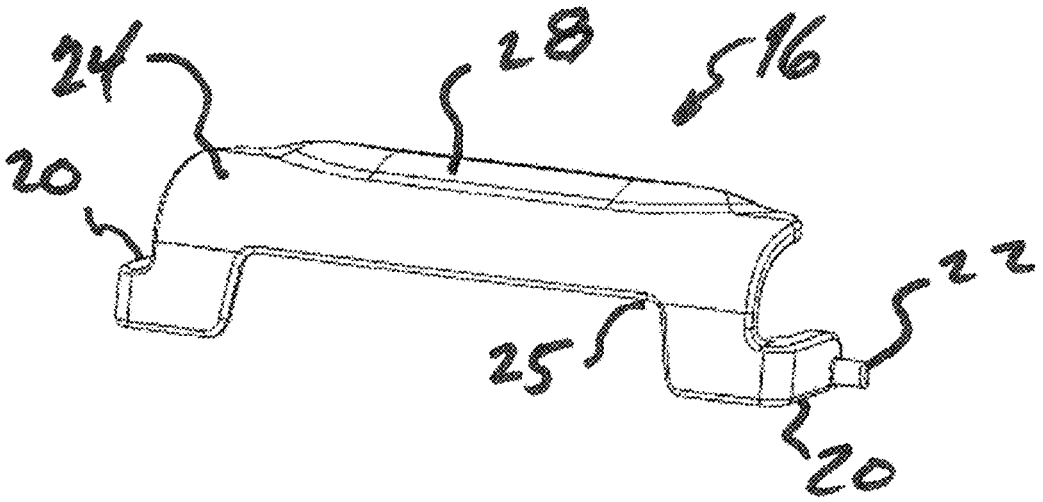
FIG. 5 is a front, top, right perspective view of the hinge of FIG. 2.
Figure 7:
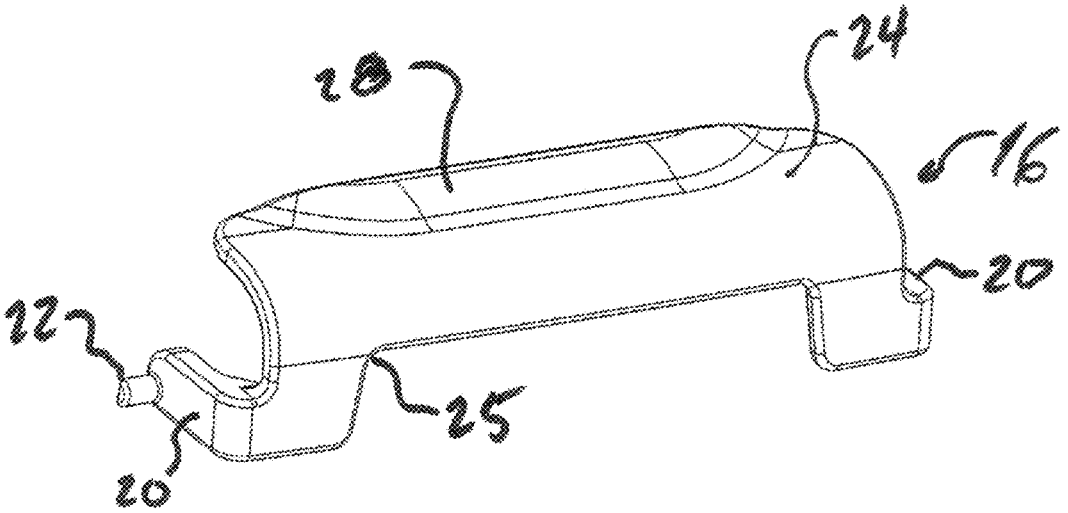
FIG. 7 is a front, top, left perspective view of the hinge of FIG. 2.
Figure 6:
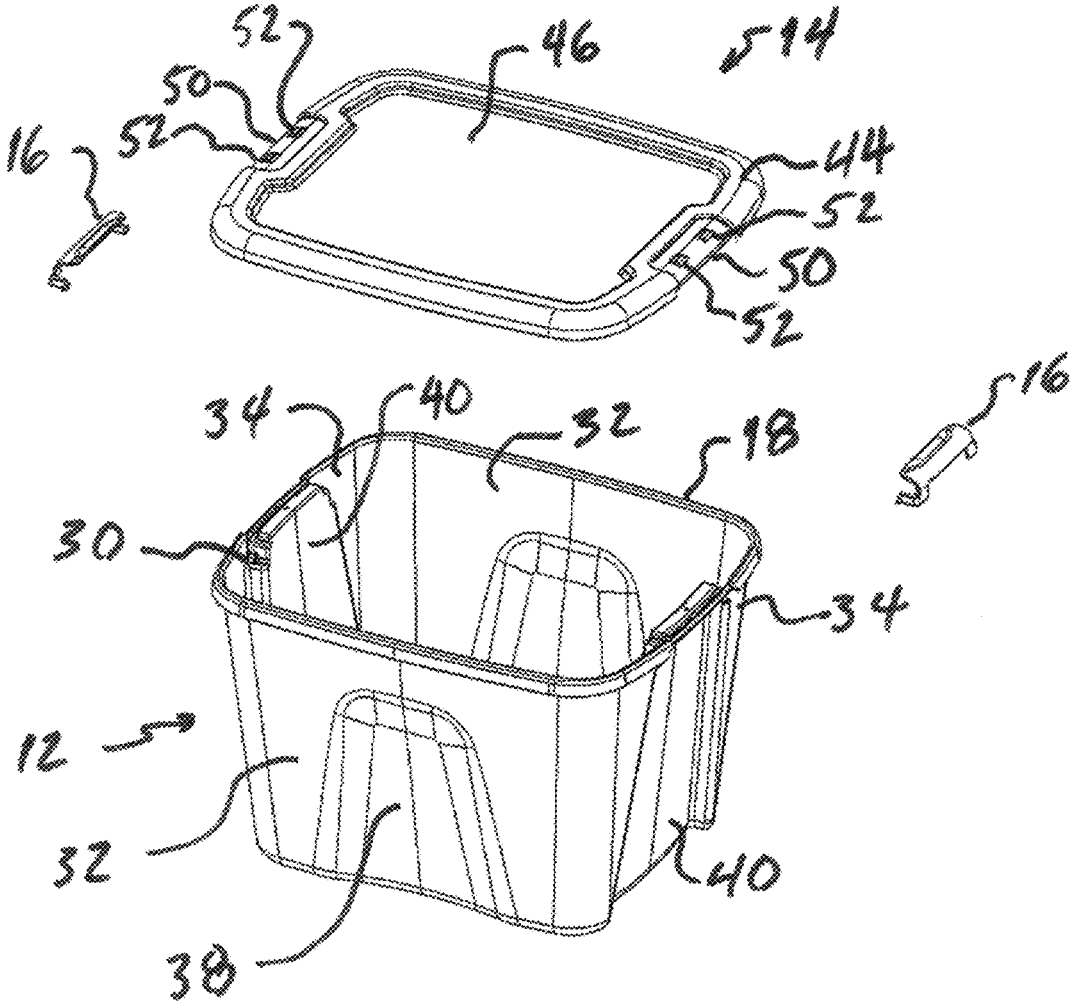
FIG. 6 is a perspective, exploded view of the tote of FIG. 1.

An embodiment provides an improved latching handle storage tote system 10 comprising a body 12 and a lid 14, as seen in FIG. 1. Integral with the body 12 are two latches 16 pivotally disposed on opposing ends of the body 12, proximate an upper free edge 18 thereof (as shown in FIG. 6). As depicted in FIGS. 2-5 and 7, each latch 16 comprises two parallel lateral arms 20. Extending orthogonally from each arm in a horizontal plane is a respective pivot pin 22 having a substantially cylindrical outer profile. The arms connect to opposite sides of an arched upper flange 24. The flange 24 may present a smooth, arched upper surface or may be provided with a slight upwardly extending region 28, as illustrated. As will be discussed, such an upwardly extending region 28 may facilitate a user disengaging the latch 16 from the tote system lid 14. Extending from a lower surface of the upper flange 24 is at least one engagement tab 26. In the illustrated embodiment of FIG. 2, two such tabs 26 are provided. An outer edge of the flange 24 defines a notch 25.

Figure 11:
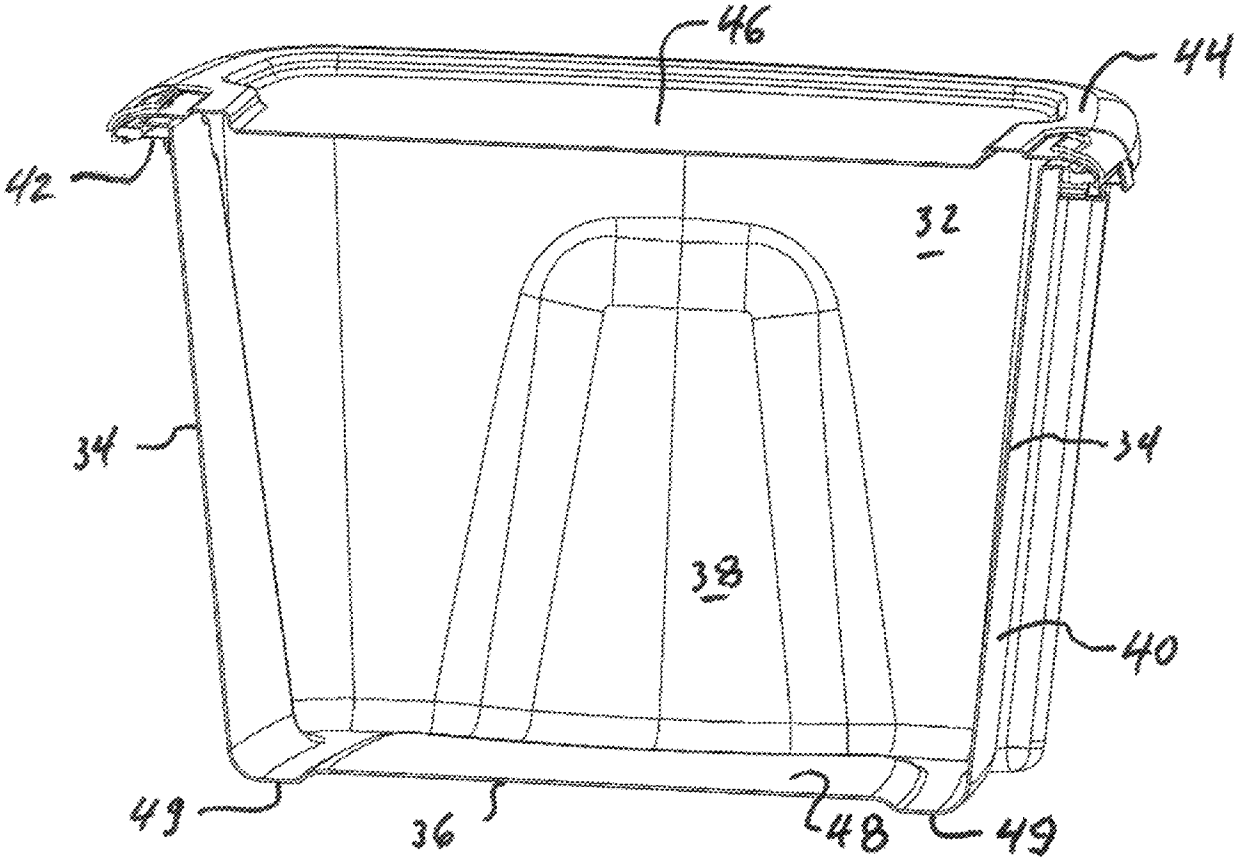
FIG. 11 is a front, right, top perspective section view of the tote of FIG. 1.

As seen in FIGS. 6 and 11, the tote body 12 has a roughly cuboid shape, with two side walls 32, two end walls 34, and a floor 36. Preferably, the side walls 32, end walls 34 and floor 36 are all part of a unitary structure that is formed of plastic in a first embodiment. The side walls 32, end walls 34 and floor 36 may have transition zones therebetween that have a given radius, or may be substantially orthogonal. The plastic may be opaque, translucent, transparent, or some combination thereof. The side walls 32 and end walls 34 terminate at the upper free edge 18. Preferably, the side walls 32 and end walls 34 are turned outwardly and downwardly to form the upper free edge.

The side walls 32 as shown throughout the Figures are provided with inwardly extending indented regions 38, though in other embodiments the side walls 32 are substantially planar. The end walls 34 are preferably provided with recessed panels 40 that have complimentary exterior and interior profiles such that plural tote bodies 12 may be efficiently vertically nested. The recessed panels 40 extend from the floor 36 to a point proximate the upper free edge 18. A portion of the upper free edge 18 extends across the upper extent of the recessed panel 40 and forms a handle 42 suitable for grasping by the fingers of a user.

Figure 8:
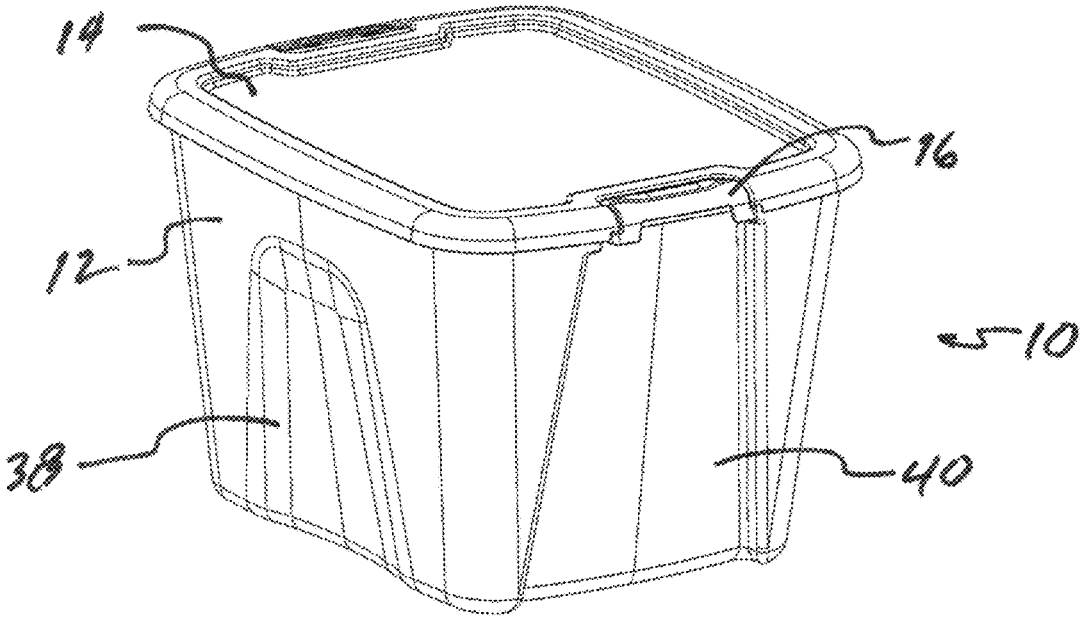
FIG. 8 is a front, right, top perspective view of the tote of FIG. 1.
Figure 16:
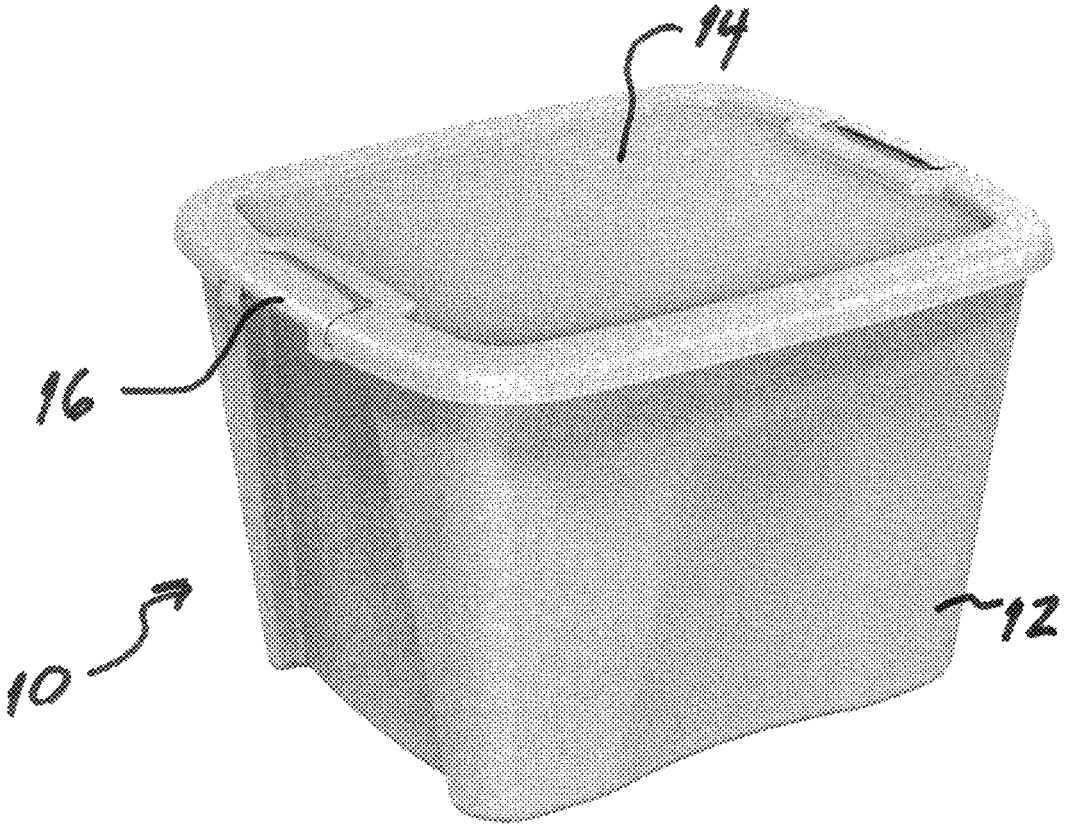
FIG. 16 is a front, left, top perspective view of the tote of FIG. 1.
Figure 18:
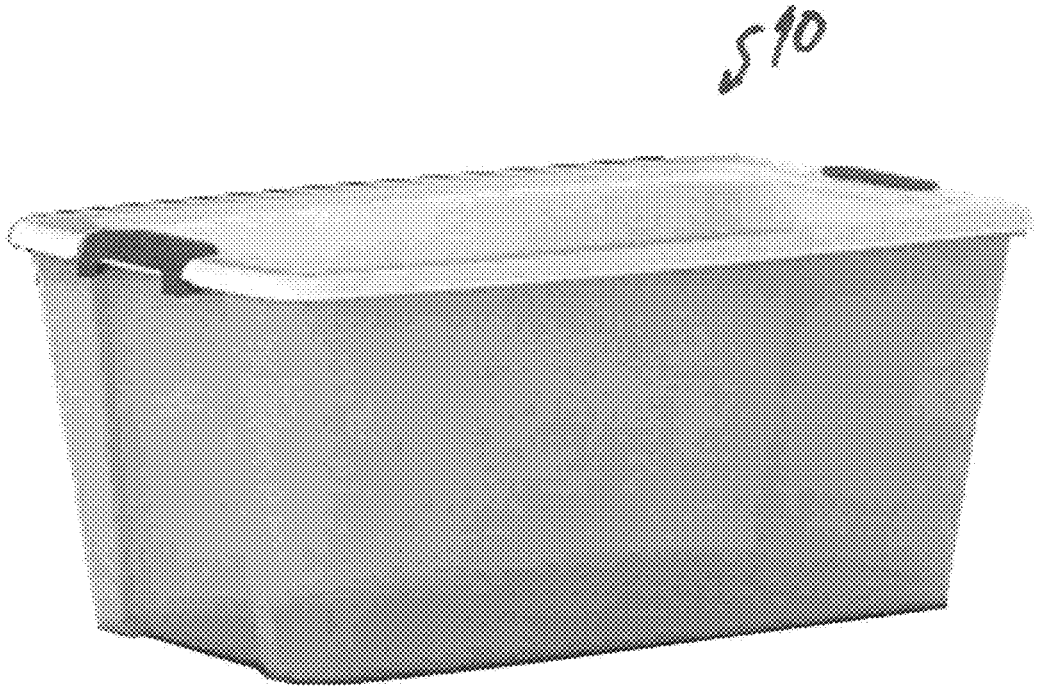
FIG. 18 is a front, left, top perspective view of another embodiment of the tote of FIG. 1.
Figure 19:
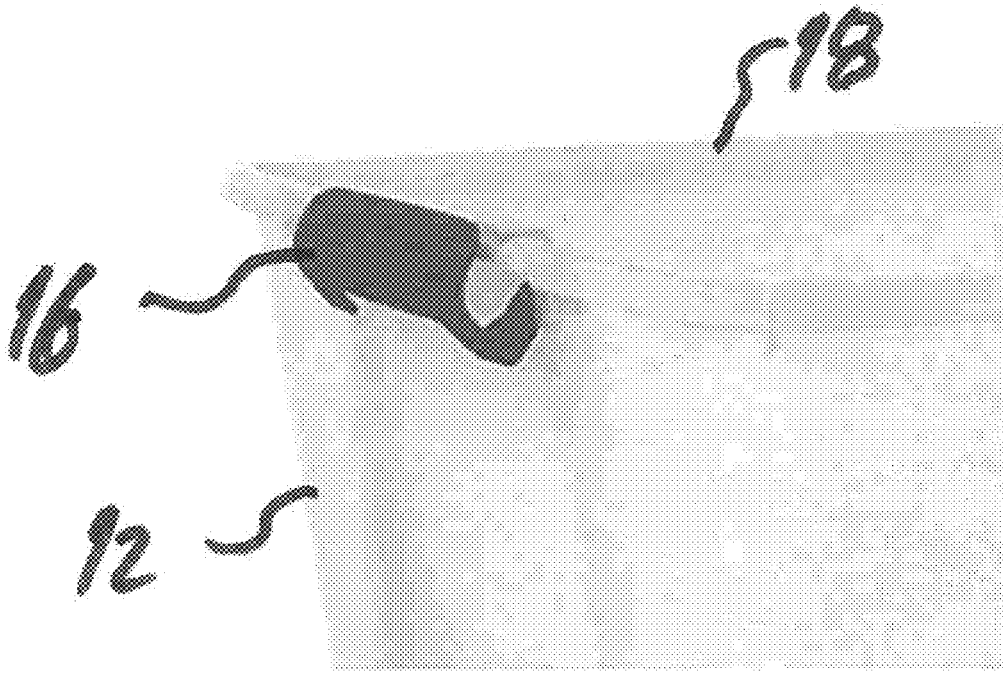
FIG. 19 is a detailed front, left, top perspective view of a tote handle and hinge.

At opposite sides of the recessed panel 40 in each tote body end wall 34, proximate the upper free edge 18, apertures 30 are provided, each configured to receive a respective one of the latch pivot pins 22. The lateral arms 20 of the latch 16 are sufficiently flexible to allow them to be temporarily deflected inwardly such that the pivot pins 22 may be inserted into the apertures 30. The latch 16 is then pivotable from an open position, such as shown in FIGS. 14, 19, 23 and 24, to a closed position suitable for engagement with the lid 14, as shown in FIGS. 8, 16 and 18 and as further discussed below.

The lid 14 is provided having a vertical projection that compliments that of the upper free edge 18 of the body 12. The lid 14 is also provided a peripheral downwardly facing groove 44, as seen in FIG. 11. The groove 44 is dimensioned such that the lid 14 rests atop the upper free edge 18 of the body 12; the outer edge of the groove 44 abuts the outer extent of the upper free edge 18 to inhibit lateral relative movement between the lid 14 and body 12.

Figure 17:
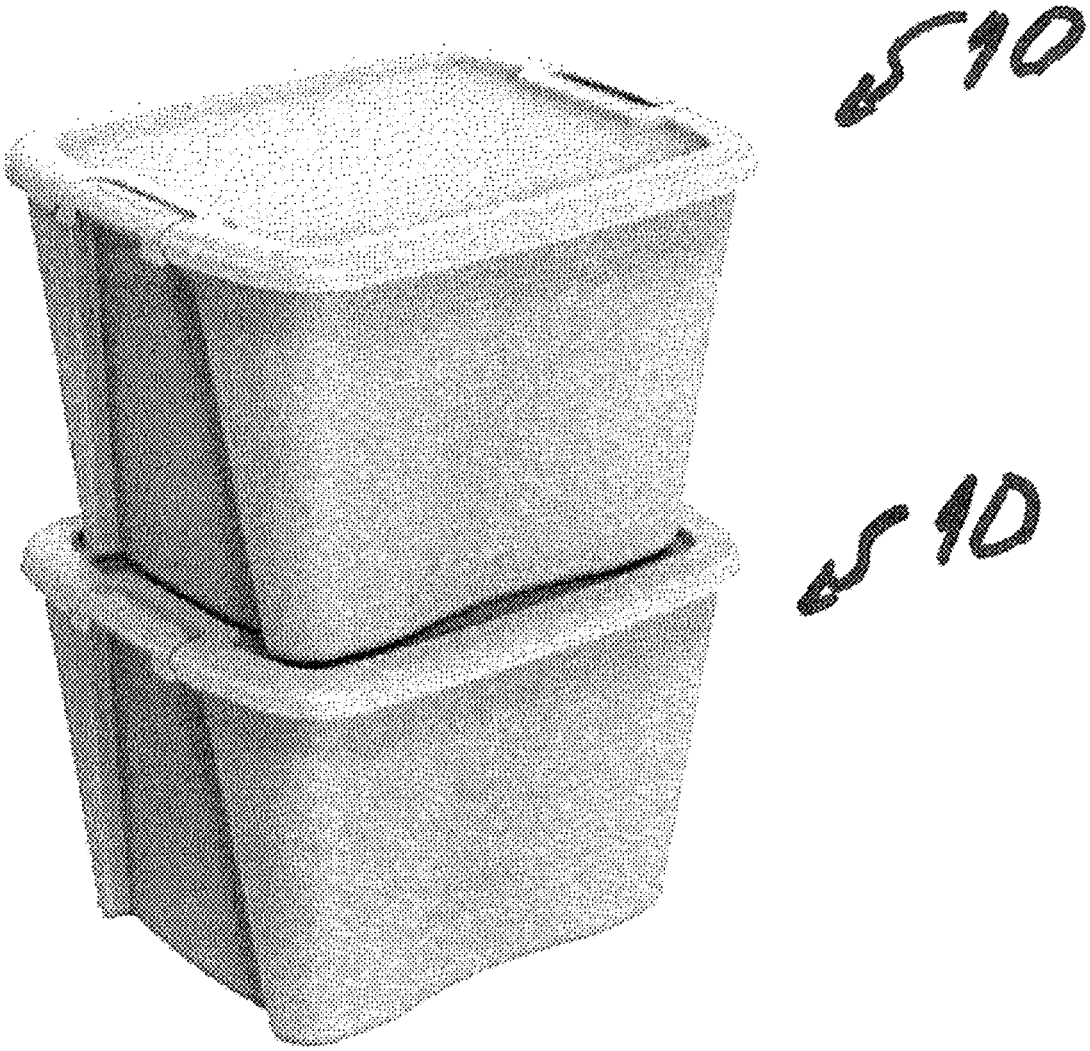
FIG. 17 is a front, left, top perspective view of two vertically stacked totes.
Figure 20:
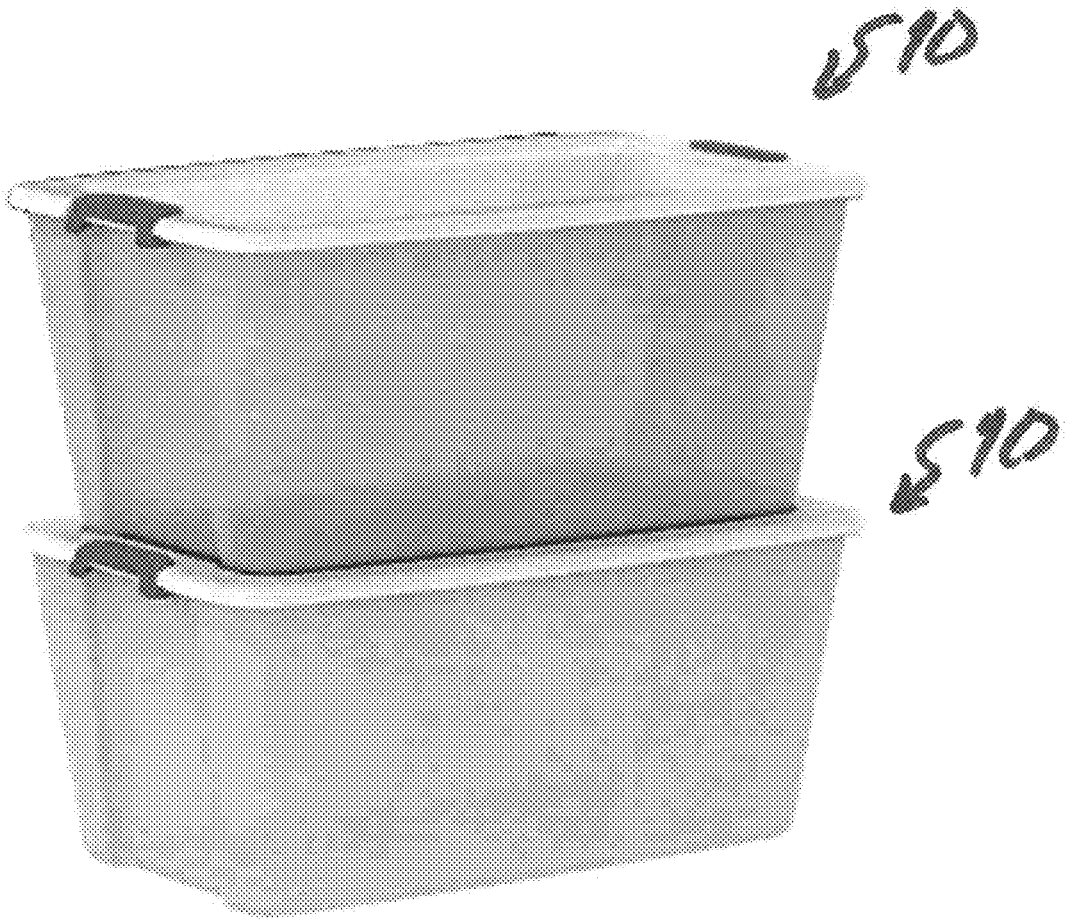
FIG. 20 is a front, left, top perspective view of two vertically stacked totes.

The downwardly facing groove 44 defines a recessed central portion 46 in the lid 14, the recessed central portion 46 having complimentary upper and lower profiles such that plural lids 14 may be vertically stacked with the lower profile of an upper lid 14 fitting within the upper profile of a lower lid 14 and with the upper profile of a lower groove 44 fitting within the groove 44 of an upper lid 14, thus minimizing the vertical height of vertically stacked lids 14. The recessed central portion 46, defined by the groove 44, is also configured to receive the floor 36 of a tote body 12 stacked vertically above the lid 14 and to inhibit lateral relative movement between the lid 14 and body 12 when totes 10 are stacked, such as shown in FIGS. 17 and 20.

Note that the floor 36 of a tote body 12 may be featureless and planar. However, in another embodiment shown in FIG. 11, the floor 36 has a central raised portion 48 surrounded by a peripheral base 49. When one tote 10 is stacked on top of another, as in FIGS. 17 and 20, the peripheral base 49 of an upper tote 10 fits within the recessed central portion 46 of the lid 14 below and lateral movement is inhibited.

Disposed at opposite ends of the lid 14 are recessed features 50 formed into the upper surface of the downwardly facing groove 44, as seen in FIG. 6. Each recessed feature is dimensioned to receive a respective latch 16 once the lid 14 is disposed on the body 12 by rotating the latch 16 about the pivot pins 22 in the apertures 30 from the open position (FIG. 14) to the closed position (FIG. 11). The latches 16 are in the open position for positioning the lid 14 onto the body 12. Once the lid 14 is in position on the body 12, each latch 16 is rotated upwards and inwards, towards the lid 14. When the arched upper flange 24 of the latch 16 is brought into contact with the upper surface of the respective recessed feature 50, the engagement tab(s) 26, projecting downwardly from the flange 24, extend into complimentary apertures 52 formed in the recessed feature 50. The latch 16 is thus held in place through the mechanical interference of the engagement tabs 26 and the apertures 52. The lid 14 is thus held in place on the body 12. To remove the lid 14, a user pulls the latches 16 outwardly and downwardly with respect to the lid 14, thereby disengaging the engagement tabs 26 from the apertures 52. Once the latches 16 are returned to the open position, the lid 14 may be lifted up and off the body 12.

Note that while the latch 16 is said to comprise at arched upper flange 24, not all of the flange 24 must be arched in all embodiments. For example, a portion of the flange 24 distal from the lateral arms 20 may in certain embodiments include a planar extent, thereby minimizing the vertical profile of the latch 16 when in the closed position in engagement with the lid 14. As previously described, the latch 16 may also be provided with a slight upwardly extending region 28, opposite the downwardly projecting engagement tabs 26, for facilitating engagement of the latch 16 with the fingers of a user.

Figure 9:
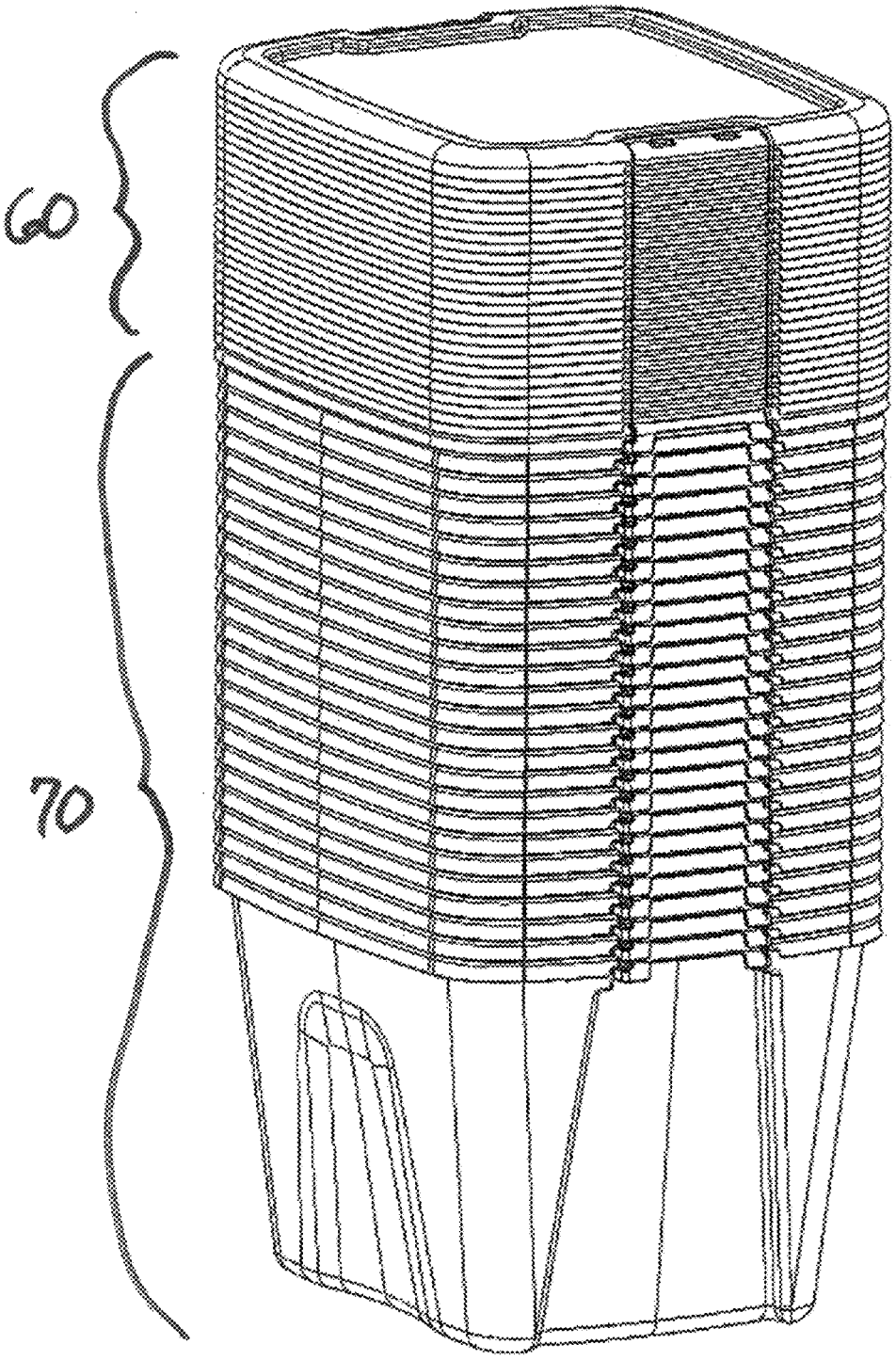
FIG. 9 is a front, right, top perspective view of plural nested tote bodies and tote lids according to the embodiment.
Figure 12:
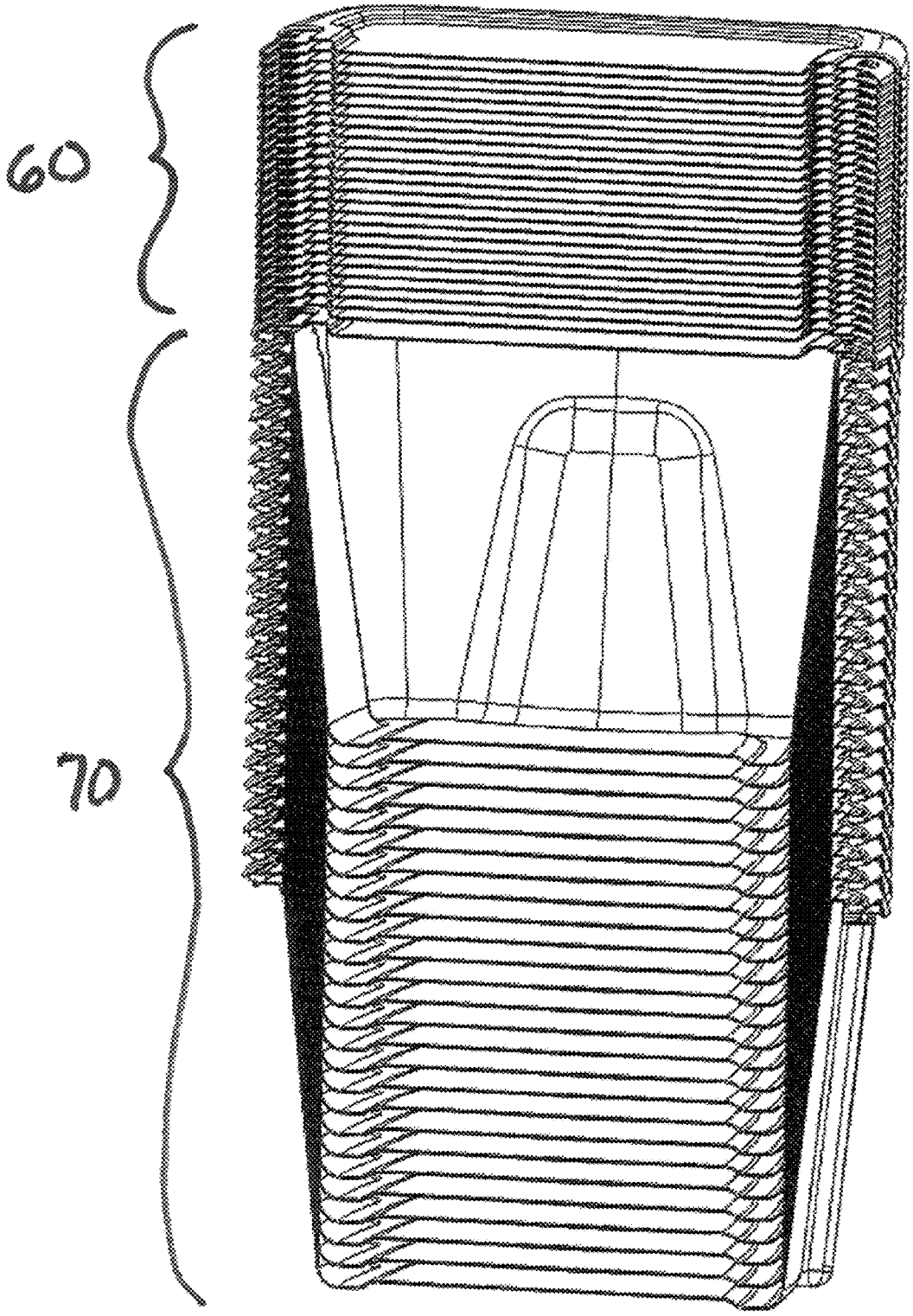
FIG. 12 is a section view of the plural nested tote bodies and tote lids of FIG. 9.
Figure 21:
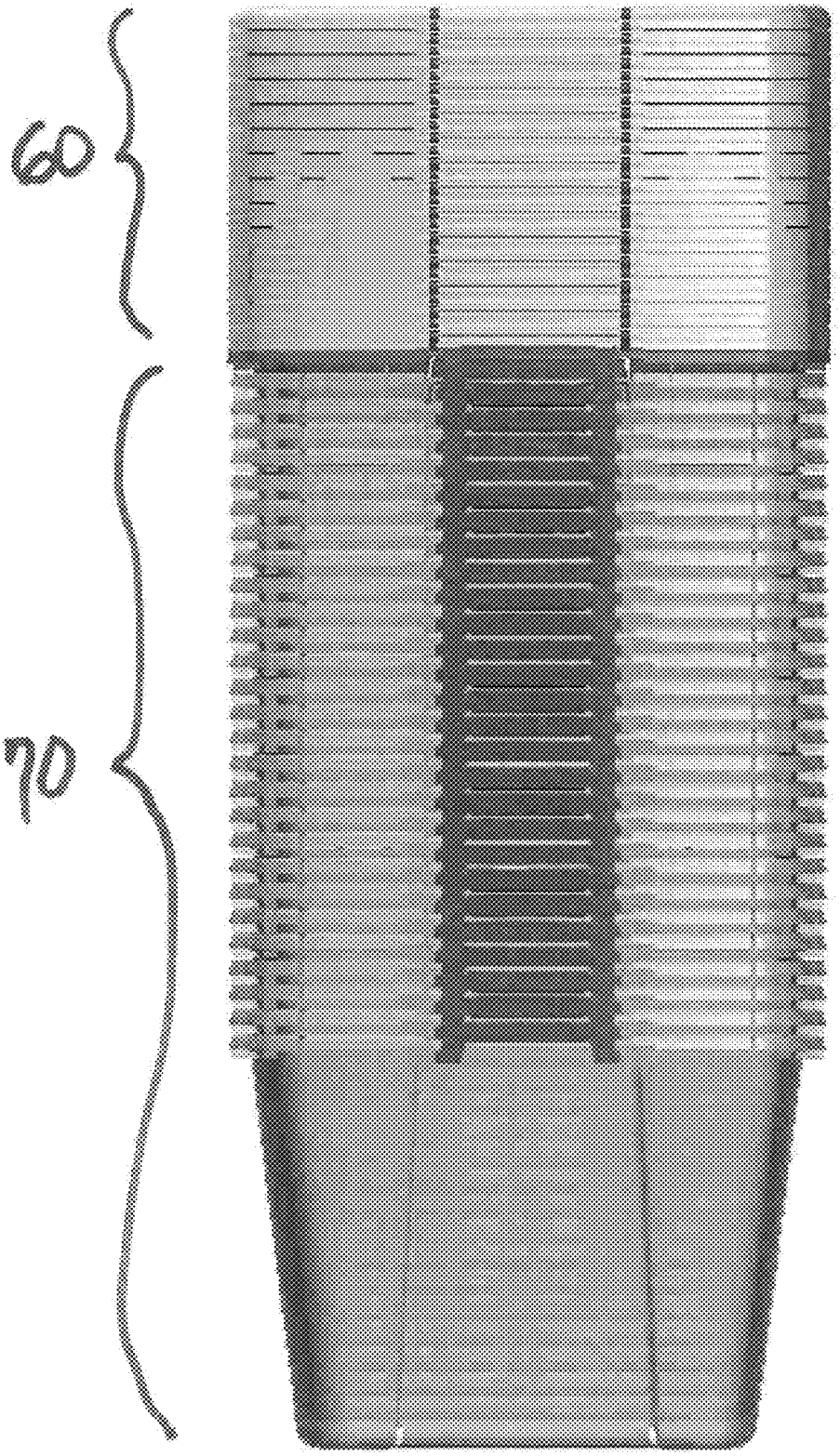
FIG. 21 is a side elevation view of plural nested tote bodies and tote lids.

Typically, totes 10 are shipped from a manufacturer and/or distributor to a vendor in vertical stacks comprising a first section 70 of plural, vertically nested bodies 12 and a second section 60 of a like number of plural, vertically stacked lids 14, as shown in FIGS. 9, 12, and 21. The presently disclosed latch 16 enables the securing of a lid 14 onto a body 12 without the need for bulky interference fit features associated with prior art totes. Thus, the vertical extent of the upper free edge 18 and the downwardly facing groove 44 can be minimized. As a consequence, more tote bodies 12 and tote lids 14 can be stacked per unit volume as compared to prior art tote systems.

Figure 10:
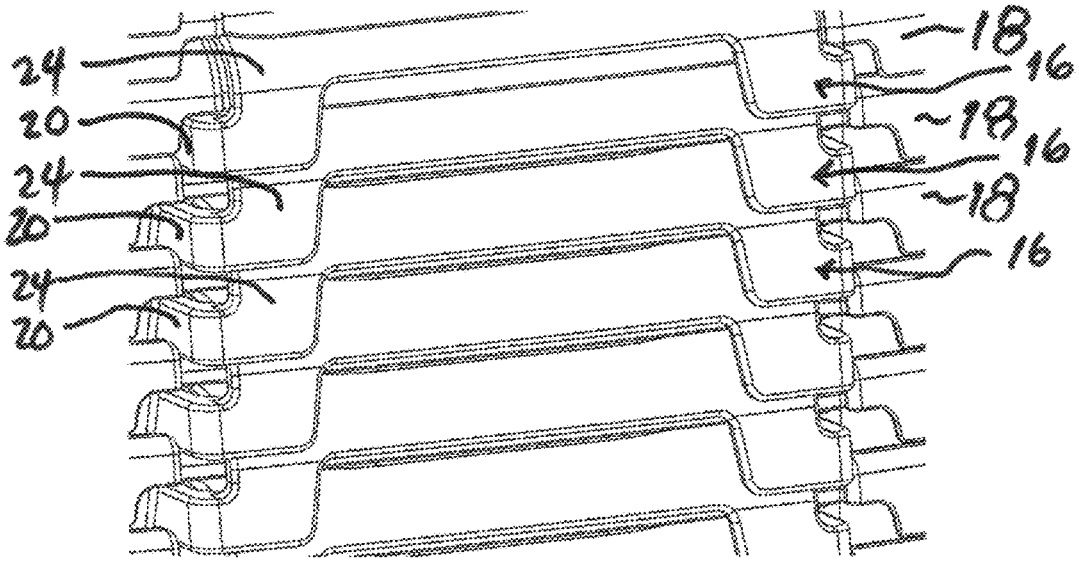
FIG. 10 is detailed view of plural nested tote bodies of FIG. 9.
Figure 13:
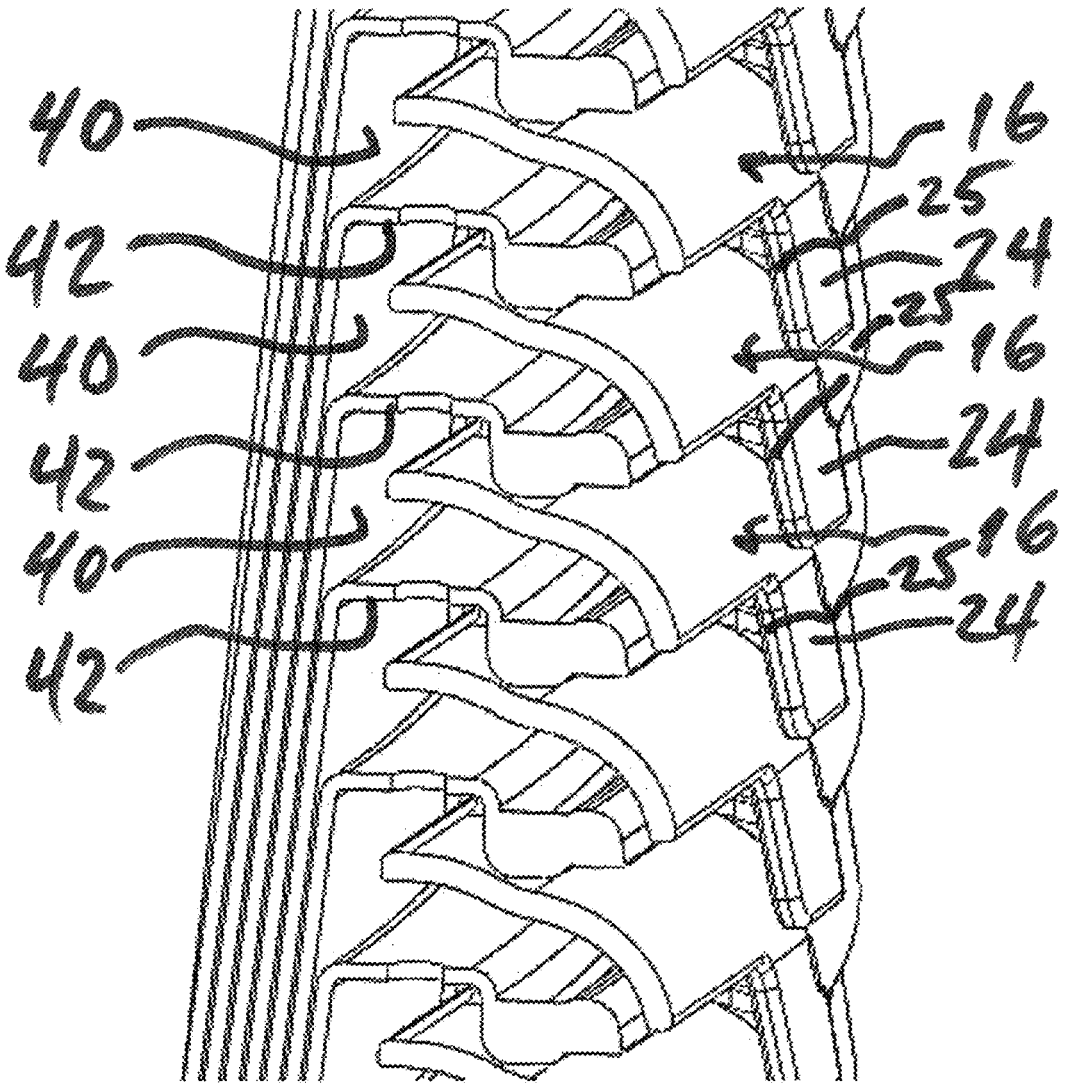
FIG. 13 is a detailed view of plural nested tote bodies of FIG. 12.
Figure 14:
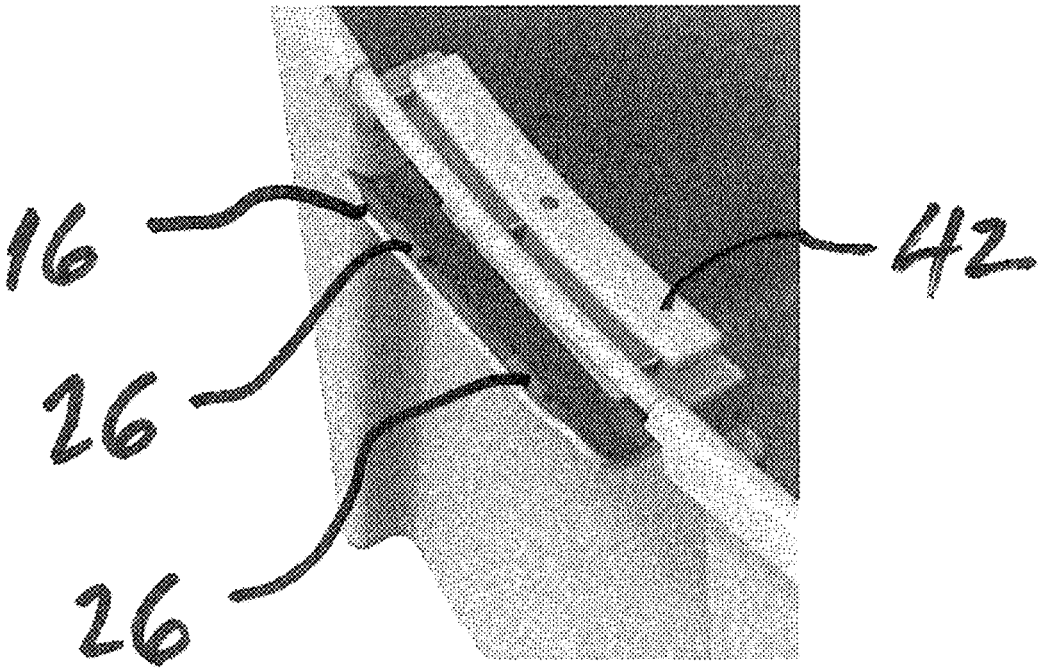
FIG. 14 is a detailed front, left, top perspective view of a tote handle and hinge on a tote body.
Figure 15:
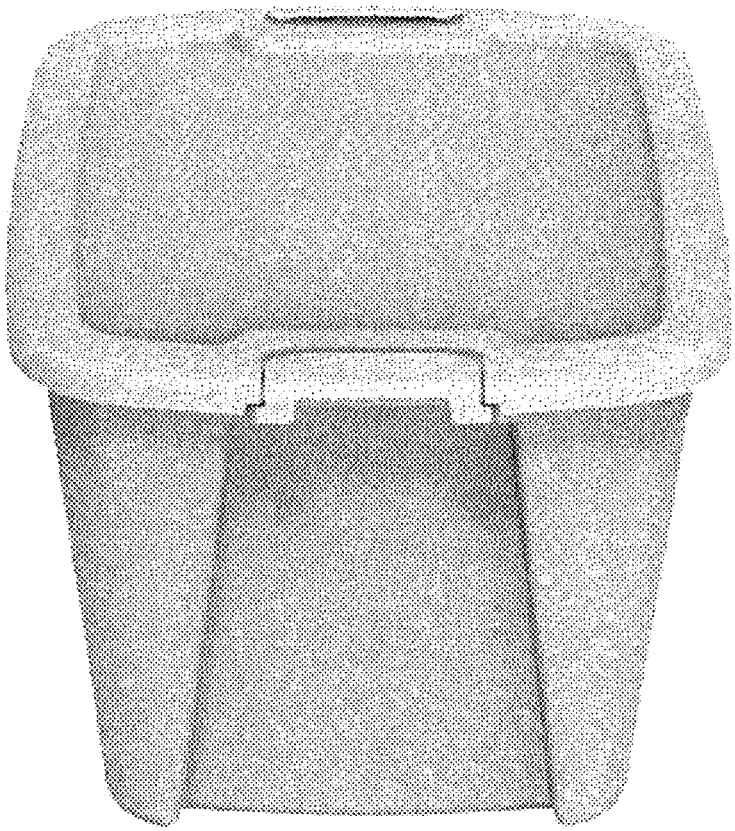
FIG. 15 is a left, top perspective view of the tote of FIG. 1.
Figure 22:
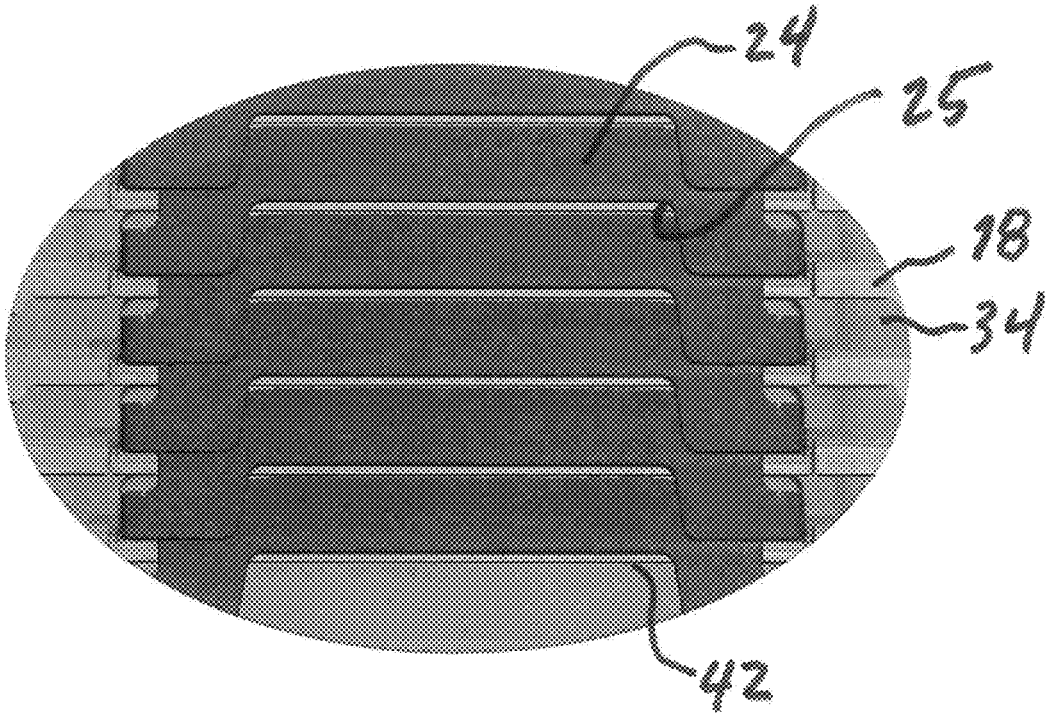
FIG. 22 is a detailed view of plural nested tote bodies of FIG. 21.
Figure 23:
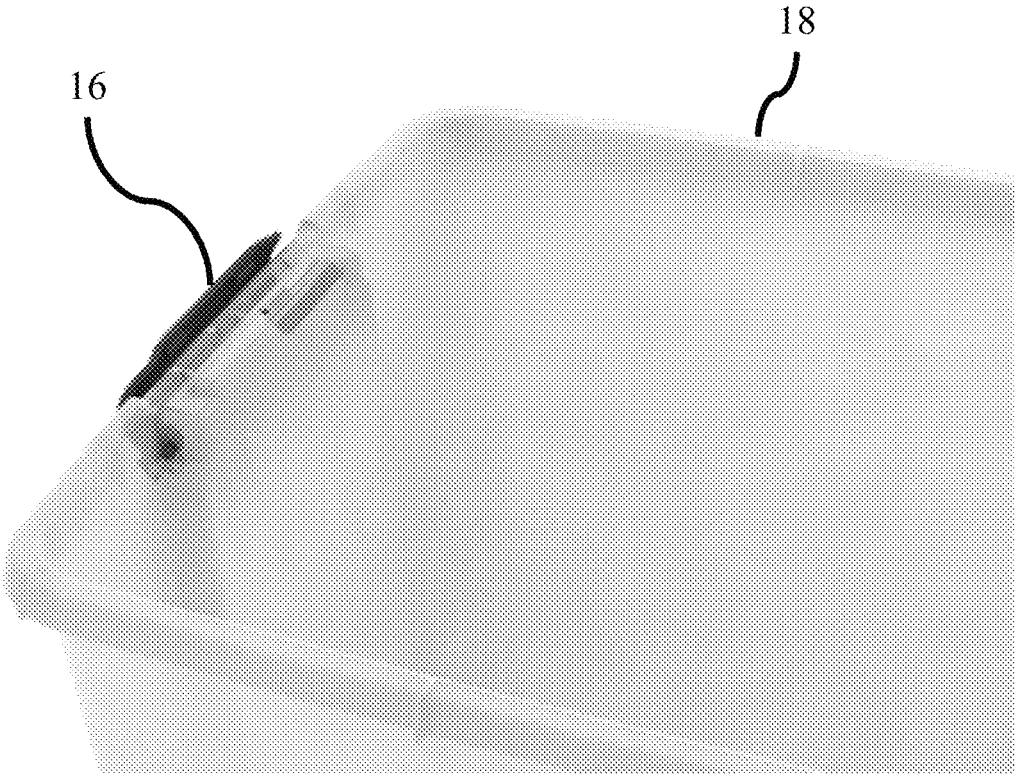
FIG. 23 is a front, right, top perspective view of a tote handle and hinge.
Figure 24:
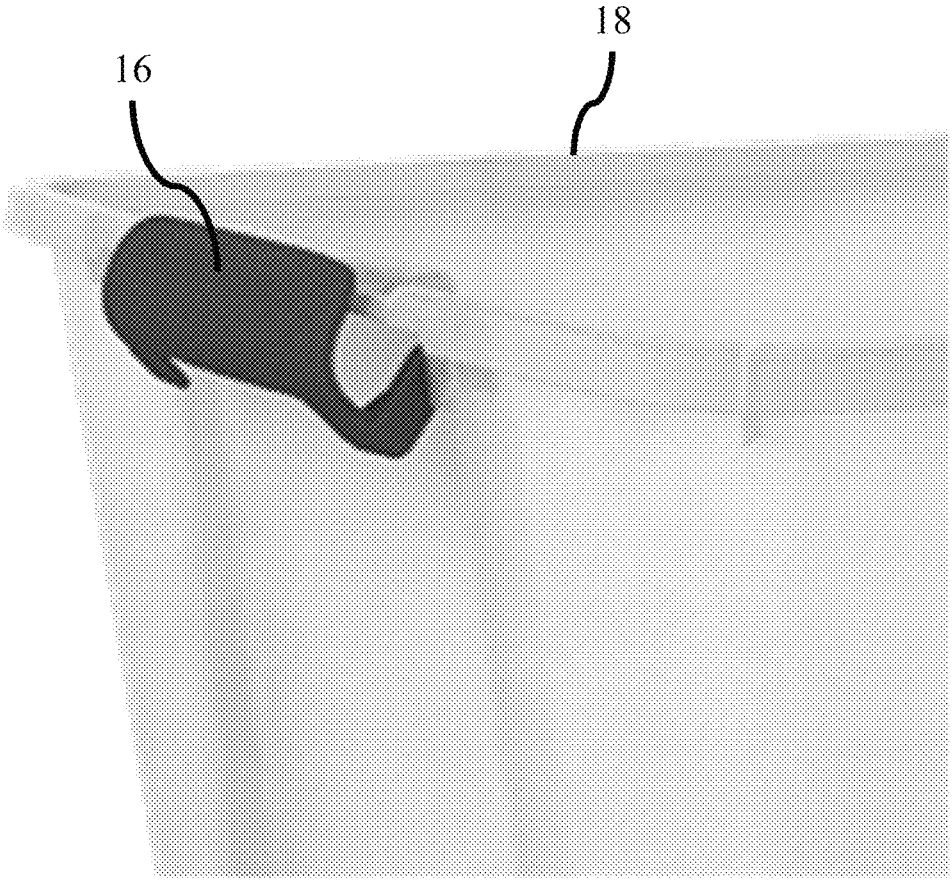
FIG. 24 is a front, left, top perspective view of the tote handle and hinge of FIG. 23.

When stacked for shipment, each latch 16 is disposed in the closed position, with the respective lateral arms 20 extending horizontally and the arched flanges 24 extending outwardly of the adjacent handle 42 and recessed panel 40, as seen in FIGS. 10, 13, and 22. In the closed position, each latch 16 fits intermediate upper and lower handles when plural tote bodies 12 are vertically stacked, thus also contributing to the ability to maximize the number of vertically stacked tote bodies 12 per unit volume. At the same time, the notch 25 of the arched flanges 24 enables a user to insert their fingertips under an outer edge of a tote handle 42 without interference, even when plural tote bodies 12 are stacked.

The foregoing description has been directed to particular embodiments. However, other variations and modifications may be made to the described embodiments, with the attainment of some or all of their advantages. Modifications to the above-described systems and methods may be made without departing from the concepts disclosed herein. Accordingly, the invention should not be viewed as limited by the disclosed embodiments. Furthermore, various features of the described embodiments may be used without the corresponding use of other features. Thus, this description should be read as merely illustrative of various principles, and not in limitation of the invention.

What is claimed is:

1. A storage tote system with latching handle, the storage tote system comprising:

a body having:

a peripheral upper edge; and oppositely disposed hinged latches disposed proximate the peripheral upper edge of the body at either end thereof, wherein each hinged latch includes two lateral arms having pivot pins, the pivot pins extending in a horizontal plane, orthogonal to the two lateral arms, wherein the two lateral arms are connected to an upper flange of the hinged latch, the upper flange having at least one engagement tab extending from a lower surface thereof; and a lid having:

an upper surface with complimentary recessed features on opposite ends, and a peripheral, downwardly facing groove, wherein each hinged latch is configured to be rotated about the respective pivot pins so that the upper flange of the hinged latch is rotated over and onto the respective complimentary recessed feature when the peripheral, downwardly facing groove is disposed on the peripheral upper edge of the body, wherein at least one aperture formed within the recessed feature of the upper surface of the lid is configured to receive the at least one engagement tab extending from the hinged latch, thus securing the lid onto the body, and wherein each hinged latch is configured to be rotated about the respective pivot pins outwardly, away from the lid in order to disengage the at least one engagement tab from the at least one aperture without deforming the lid.

2. The storage tote system of claim 1, wherein the body further comprises recessed panels that extend into an interior of the body.

3. The storage tote system of claim 2, wherein the recessed panels are disposed on at least one of: side walls and ends of the body.

4. The storage tote system of claim 2, wherein each recessed panel defines a handle configured to be suitable for engagement by a user for lifting and carrying the tote.

5. The storage tote system of claim 2, wherein an interior profile of the recessed panel is dimensioned to be received within the exterior profile of a recessed panel of a second tote that is disposed within the body.

6. The storage tote system of claim 1, wherein the lid has a recessed central portion and a downwardly facing groove.

7. The storage tote system of claim 6, wherein the downwardly facing groove of the lid is configured so as to fit over an upper surface of a groove of a second, identical lid and such that the recessed central portion extends downwardly into the recessed central portion of the second, identical lid when stacked together.

8. The storage tote system of claim 1, wherein the upper flange of each hinged latch comprises one of: a smooth arched upper surface, and an upwardly extending region.

9. The storage tote system of claim 1, wherein the body is formed of plastic.

10. The storage tote system of claim 1, wherein the body comprises side walls and end walls, and the side walls and end walls are turned outwardly and downwardly to form the peripheral upper edge.

11. The storage tote system of claim 1, wherein the body comprises side walls and end walls, and the side walls and end walls have complimentary exterior and interior profiles.

* * * * *